US005524597A

United States Patent [19]

Hiki et al.

[11] Patent Number: 5,524,597

[45] Date of Patent: Jun. 11, 1996

[54] IGNITION SYSTEM FOR WATERCRAFT

[75] Inventors: Keiichi Hiki; Naoki Katoh; Ryoichi Nakase, all of Hamamatsu, Japan

[73] Assignee: Sanshin Kogyo Kabushiki Kaisha, Hamamatsu, Japan

[21] Appl. No.: 349,560

[22] Filed: Dec. 5, 1994

[30] Foreign Application Priority Data

Dec. 6, 1993 [JP] Japan ..... 5-305481
Dec. 6, 1993 [JP] Japan ..... 5-305483

[51] Int. Cl.[6] ..... F02P 3/00

[52] U.S. Cl. ..... 123/635; 123/198 E

[58] Field of Search ..... 123/198 E, 635

[56] References Cited

U.S. PATENT DOCUMENTS 4,134,370 1/1979 Iwahashi et al. ..... 123/198 E

*Primary Examiner* Noah P. Kamen
*Attorney, Agent, or Firm* Knobbe, Martens, Olson & Bear

[57] ABSTRACT

An engine assembly for powering a watercraft that has a front cover which contains a number of electrical components for the engine including the flywheel magneto of the engine, a CDI ignition system for firing the spark plugs and additional components. This permits ease of servicing and reduces the number and length of the interconnecting electrical conduits.

22 Claims, 12 Drawing Sheets

IGNITION SYSTEM FOR WATERCRAFT

BACKGROUND OF THE INVENTION

This invention relates to an ignition system for an engine and more particularly to an improved engine ignition system particularly adapted for use with watercraft.

As is well known, most spark ignited engines include a number of electrical components. These may include components such as a magneto generator which is driven by the engine flywheel and which provides not only an electrical power output but also pulse signals indicative of the angular position of the crankshaft. The outputs from these coils are transmitted to an ignition circuit which processes the signals and generates an output signal that is transmitted normally to a spark coil. The voltage of the signal is amplified by the spark coil and then is transmitted to the spark plugs for firing.

Obviously, the system employs a number of components which are not always located in proximity to each other. Where that is the case, conductors must be provided for transferring the electrical energy from one location to another.

Although this type of arrangement is satisfactory, it presents certain problems in certain applications. For example, when utilized as the ignition system for the powering internal combustion engine of a watercraft and particularly a small type of watercraft known as a personal watercraft, it is desirable to enclose at least some if not all of the components so that they will be protected from the water. This is particularly true when operating in a marine environment. However, if the components are located at spaced locations from each other then conductors must pass in and out of the housings in which the various components are contained thus increasing the difficulties in obtaining sealing. In addition, when the components are spaced from each other, this presents some difficulties.

It is, therefore, a principal object of this invention to provide an improved ignition system for a watercraft.

It is a further object of this invention to provide an improved engine ignition system for a watercraft wherein many of the major components are sealed within the same housing assembly.

It is a yet further object of this invention to provide an improved and compact sealed ignition system for an engine wherein the components are all positioned in proximity to each other and the number of external connections is substantially reduced.

SUMMARY OF THE INVENTION

This invention is adapted to be embodied in combination with an internal combustion engine that is comprised of a cylinder block that forms at least one cylinder bore. A crankcase member is affixed to the bottom of the cylinder block and contains a crankshaft driven by a piston in the cylinder bore. A cylinder head is affixed to the top of the cylinder block and encloses the cylinder bore. At least one spark plug is mounted in the cylinder head for firing a charge in the cylinder bore. A front cover is affixed to the engine contiguous to an end face thereof. The crankshaft has a portion that extends into the front cover. A coil is mounted in this front cover and is juxtaposed to the crankshaft for generating an electrical output upon rotation of the crankshaft. An engine ignition system is received in the front cover for receiving an output from said coil and generating a control signal and a power signal for firing the spark plug.

DETAILED DESCRIPTION OF THE PREFERRED EMBODIMENTS OF THE INVENTION

Figure 1:
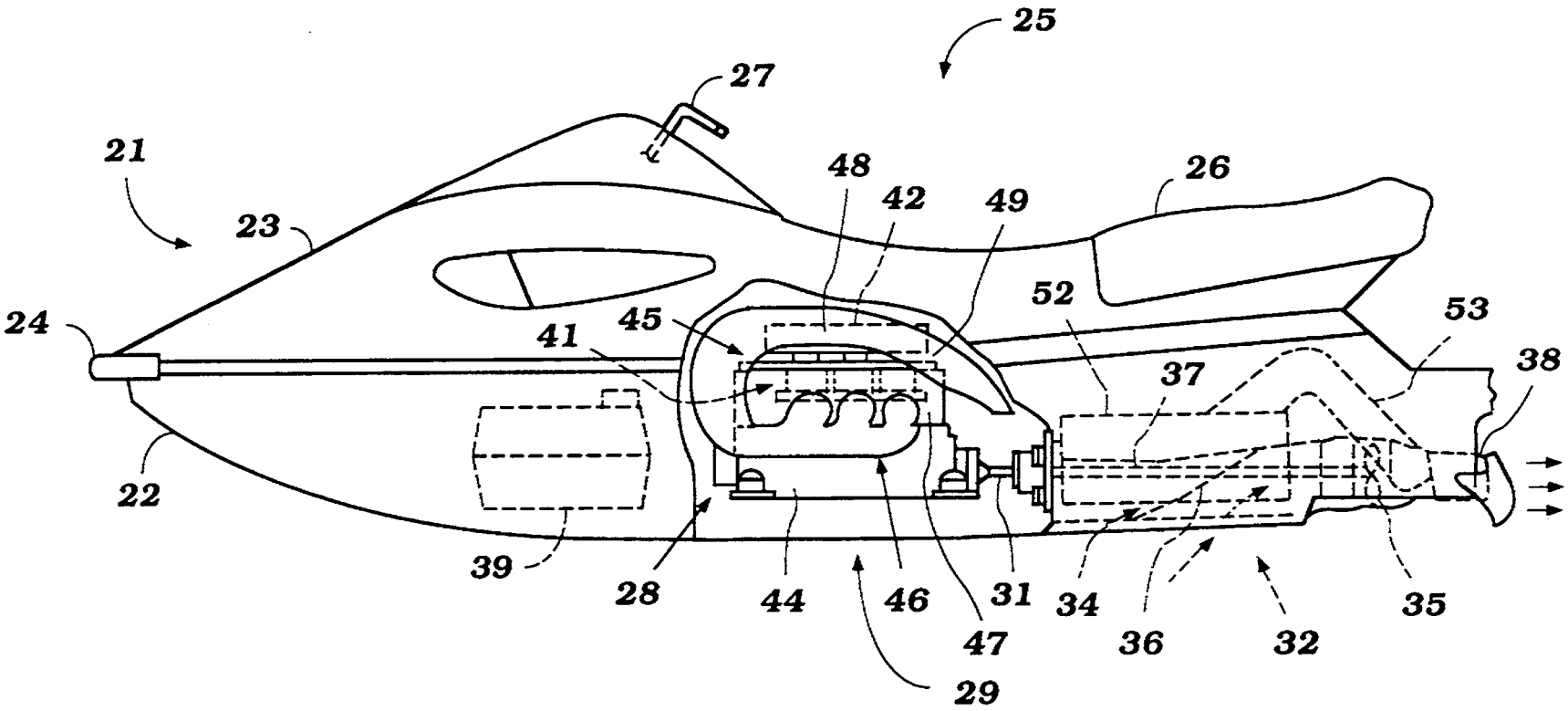
FIG. 1 is a side elevational view of a personal watercraft, with a portion broken away, powered by an engine having an ignition system constructed in accordance with an embodiment of the invention.
Figure 2:
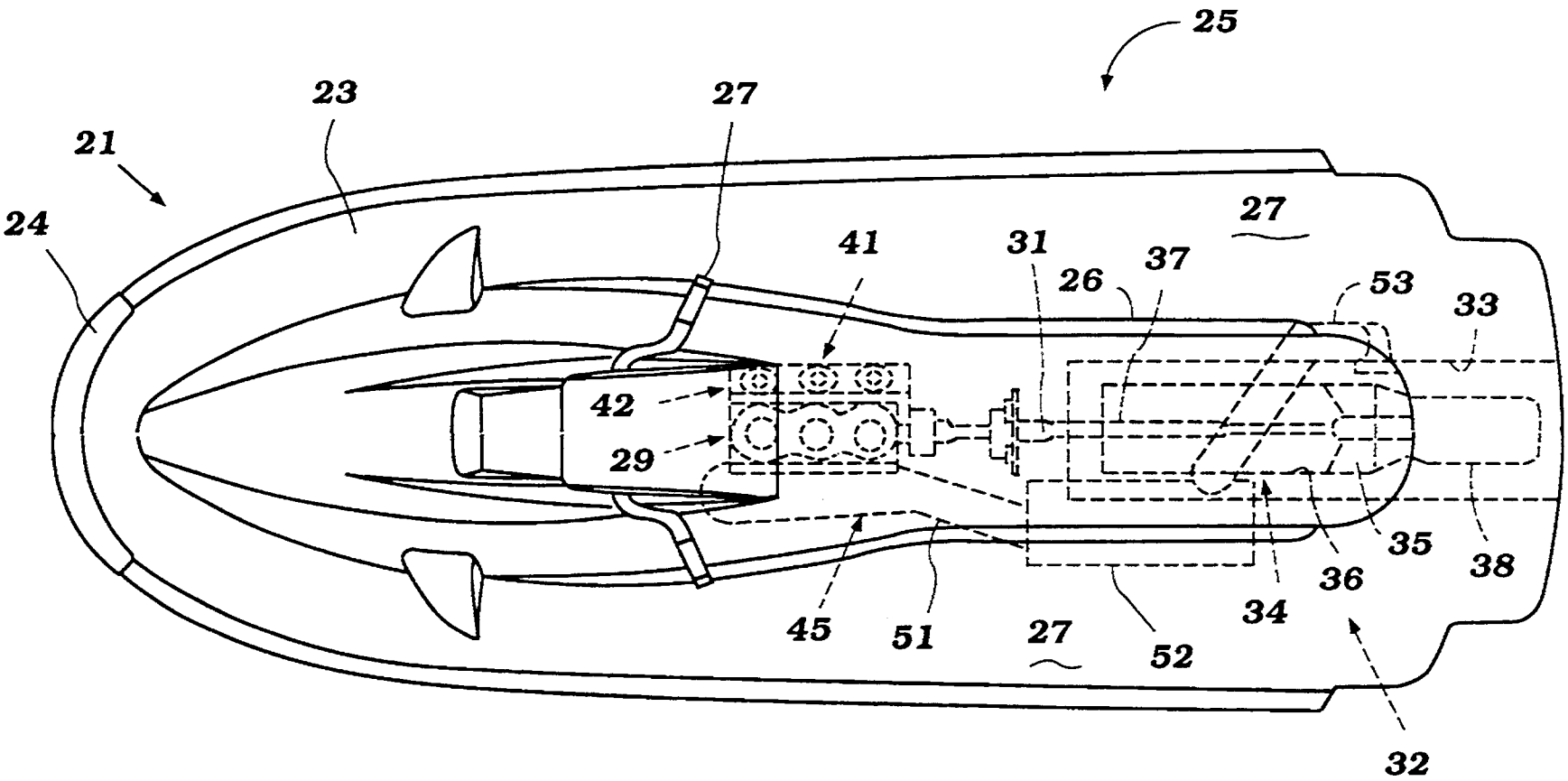
FIG. 2 is a top plan view of the watercraft.

Referring now in detail to the drawings and initially to FIGS. 1 and 2, a small personal watercraft constructed in accordance with an embodiment of the invention is identified generally by the reference numeral 21. As will become apparent, the invention deals with the engine and ignition system for the engine. The invention has particular utility, however, in conjunction with marine propulsion units and particularly engines for powering small personal watercraft of the illustrated type because of the fact that they normally are operated in such a way where water may come in contact with the exterior of the engine. Therefore, the construction of the watercraft 21 as will be described are to be considered as only exemplary of the type of watercraft with which the invention can be employed.

The watercraft 21 is comprised of a hull having a lower hull portion 22 and an upper deck portion 23. The hull and deck portions 22 and 23 may be formed from any suitable material such as a molded fiberglass reinforced resin or the like. The hull 22 and deck 23 portions are affixed to each other in any suitable manner and a bumper 24 may be provided at the forward end of their mating edges.

The watercraft 21 is provided with a rearwardly positioned rider's area, indicated generally by the reference numeral 25 and which is comprised of a raised centrally positioned seat 26 that is adapted to accommodate one or more riders seated in straddle tandem fashion. Foot areas 27 are disposed on the deck 23 outwardly of the seat 26 so as to accommodate the feet of the thus seated riders. If desired, the seat 26 may be configured so that these riders sit in a manner like the riders of a motorcycle are seated.

Positioned forwardly of the seat 26 within the rider's area 25 is a control handlebar assembly 27 that is provided for steering of the watercraft 21 in a manner which will be described and also for control of the engine speed and other engine control, as is well known in this art.

The hull of the watercraft 21 is formed so as to provide an engine compartment, indicated generally by the reference numeral 28 which, in the illustrated embodiment, is disposed in part beneath the forward portion of the seat 26. An internal combustion engine 29 is mounted in any suitable manner within this engine compartment 28 and has an output shaft 31 which is coupled so as to drive a jet propulsion unit, indicated generally by the reference numeral 32. The jet propulsion unit 32 is disposed within a tunnel 33 formed at the rear central portion of the hull portion 22.

The jet propulsion unit, as is typical with this type of device, is comprised of an outer housing assembly which has a water inlet portion 34 that has a downwardly facing water inlet opening through which water may be drawn. This water is drawn by an impeller 35 that is journaled within the outer housing and which draws water through a duct 36 that extends from the water inlet portion 34. The impeller 35 is affixed to an impeller shaft 37 which is drivingly coupled to the engine output shaft 31 in any well known manner.

The water pumped by the impeller 35 is discharged rearwardly through a discharge nozzle 38 which has a portion that is journaled for steering movement about a vertical extending steering axis. This steering nozzle portion is connected to the handlebar assembly 27 for steering in a manner as well known in this art.

Positioned in the engine compartment 28 forwardly of the engine 29 is a fuel tank 39 which has a fill neck which is accessible externally and which contains fuel for the engine 29. This fuel is supplied to an induction and charge forming system, indicated generally by the reference numeral 41 and which is disposed at one side of the engine.

In the illustrated embodiment, the engine 29 is of the three cylinder, in-line, two-cycle crankcase compression type. It will be readily apparent to those skilled in the art, however, that the invention may be employed with engines having other cylinder numbers or other cylinder configurations. In addition, the invention may be employed with engines operating on the four stroke rather than the two stroke principle.

Figure 7:
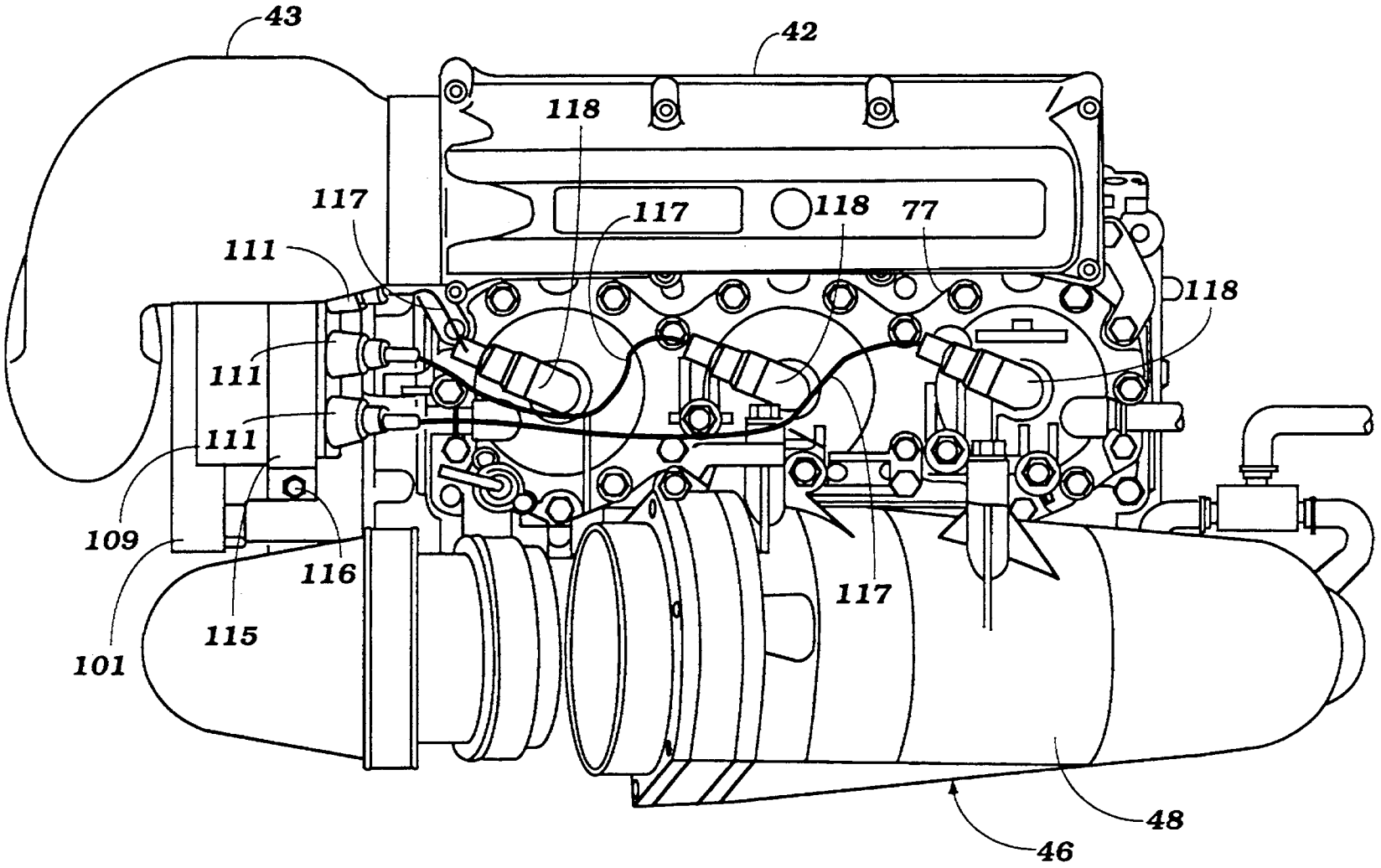
FIG. 7 is an enlarged top plan view of the engine.

The induction system 41 includes an air inlet device 42 which draws atmospheric air from within the engine compartment 28 through a suitable air inlet. This air inlet is shown partially in FIG. 7 and is identified by the reference numeral 43. Basically it is comprised of a downwardly facing air inlet opening so that the air that is drawn into the induction system 41 will have separated from it water which may be present in the engine compartment 28.

This air is then mixed with fuel in a series of carburetors that are disposed beneath the air inlet device 42 and which supply a fuel air charge to the crankcase chambers of the engine 29 formed in part by a crankcase member 44 that is affixed thereto in a well known manner and as will become more apparent through reference to later figures.

The charge which is burned within the engine 29 is discharged to the atmosphere through an exhaust system, indicated generally by the reference numeral 45. This includes an exhaust manifold 46 that is affixed to the side of the engine and which receives the exhaust gases from exhaust ports formed in a cylinder block 46 of the engine to which the crankcase member 44 is affixed. These exhaust gases are then transferred to an expansion chamber 48 that is disposed above the exhaust manifold 46 and which is inclined downwardly and rearwardly to end at a discharge end 49. The discharge end 49 is connected to an exhaust pipe 51 which, in turn, extends to a water trap device 52 positioned on one side of the tunnel 33. This water trap device 52 operates, as is well known in this art, so as to prevent water from entering the engine 29 through its exhaust system 45.

A trap pipe 53 extends from the water trap device 52 beneath the seat 26 and across the top of the tunnel 33. A discharge end of this trap pipe 53 enters into the tunnel 33 so that the exhaust gases will be discharged to the atmosphere through the body of water in which the watercraft is operating for silencing purposes. In addition, this shields the exhaust gases from the outer surface of the hull portion 22 so that it will not be discolored.

The construction of the watercraft 21 and its propulsion system including the jet propulsion unit 32 as thus far described may be considered to be that of a conventional structure. As has been noted, the invention may be utilized with a wide variety of types of watercraft including those embodying different types of propulsion units than jet propulsion. Therefore, the foregoing description may be considered only necessary to permit those skilled in the art to understand the environment in which the invention is applied.

The construction of the engine 29 will now be described in more detail particularly by reference initially to FIG. 3. As has been noted, the engine 29 includes a cylinder block 47 to which the crankcase member 44 is affixed. The cylinder block 47 is provided with three in-line cylinder bores 54 each formed by a respective cylinder liner 55. Although the cylinder bores 54 are formed in the illustrated embodiments by liners 55, it should be readily apparent that the cylinder bores 54 may be formed directly in the material of the cylinder block 47.

Pistons 56 are slidably supported within the cylinder bores 54 and are connected to the upper or small ends of connecting rods 57 by means of piston pins 58. The lower or big ends of the connecting rods 57 are journaled on the throws 59 of a built up crankshaft assembly, indicated generally by the reference numeral 61.

Figure 11:
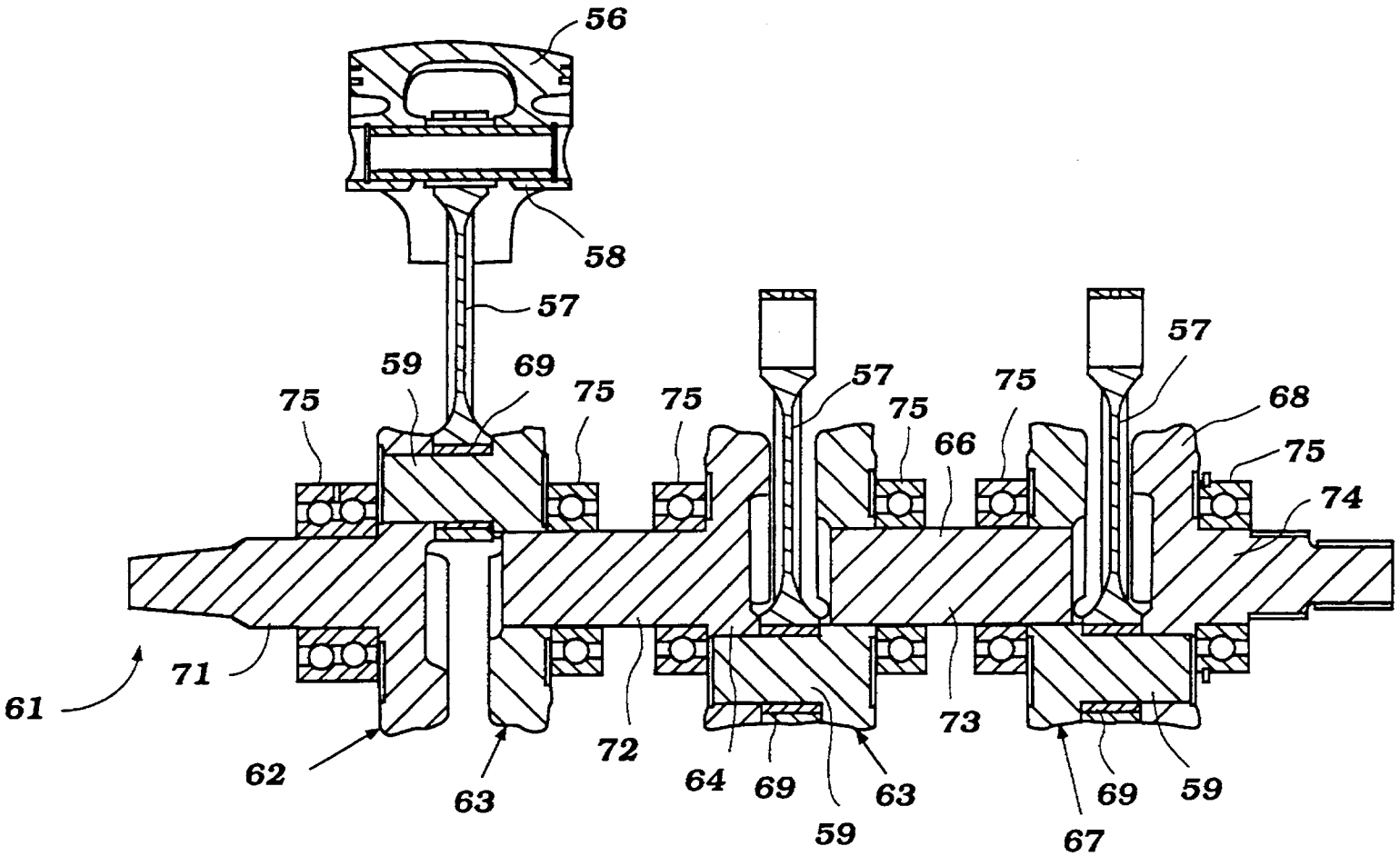
FIG. 11 is an enlarged cross-sectional view taken through the crankshaft of the engine showing its relationship to the pistons and connecting rods and with other portions removed.

As may be best seen in FIG. 11, the crankshaft assembly 61 is comprised of a plurality of interconnected segments 62, 63, 64, 65, 66, 67, and 68. The segments 63, 65, and 67 each form respective throws 59 that are received within complementary bores formed by the segments 62, 64, and 68. This permits use of needle type bearings 69 for the big ends of the connecting rods 57. The segments 62, 64, 66, and 68 have respective cylindrical portions 71, 72, 73, and 74 that are received in main bearings 75 of the ball race type. These main bearings 75 are fixed in webs of the crankcase member 44, referring again to FIG. 3.

As has been noted, the induction system 41 supplies a fuel air charge to the crankcase chambers of the engine 29. Thus, the crankcase chamber associated with each of the cylinders bores 54 is sealed from the others in a manner well known in this art.

This intake charge is delivered to the crankcase chambers through induction passages in which reed type check valves are provided so as to permit the charge to flow into the crankcase chambers as the pistons 56 move upwardly in the cylinder bores 54. The check valves will close as the pistons 56 move downwardly to compress the charge in the crankcase chambers. This type of construction is well known in the art and, for that reason is not illustrated.

A combustion chamber is formed by each cylinder bore 54, the head of the respective piston 56 and a combustion chamber recess 76 formed in a cylinder head assembly 77 that is affixed to the cylinder block 47 in a well known manner. The charge which has been compressed in the crankcase chambers is transferred to this combustion chamber by one or more scavenge passages 78 that are formed in the cylinder block 47 and which extend from the crankcase chambers and terminate in scavenge ports formed around the periphery of the cylinder bore 54 in a well known manner.

This charge is then further compressed in the combustion chamber and fired by a respective spark plug 79 that is affixed in the cylinder head assembly 77 and which registers with each of the cylinder head recesses 76. The spark plugs 79 are fired by an ignition system which will now be described initially by continued reference to FIG. 3.

It should be noted that the front of the crankcase member 44 defines a cavity 81 in which a flywheel magneto assembly 82 is positioned. This flywheel magneto assembly 82 is comprised of a flywheel portion 83 that is affixed to the front of the crankshaft 61 and specifically the cylindrical portion 71 by means of a threaded fastener 84. This flywheel magneto assembly 82 further includes a series of segmented permanent magnets 85 that are affixed to an annular hub portion of the flywheel 83.

A front cover assembly, indicated generally by the reference numeral 86 is affixed to the front of the engine 29 and is comprised of a first cover member 87 that has a hub portion 88 which is surrounded by a recess 89. The cover member 87 has an outer flange that forms a mating seal around the cylindrical cavity 81 of the crankcase member 44 so as to provide a sealed chamber around the flywheel magneto 82.

A plurality of coils 91 are carried by the cover member 87 and cooperate with the permanent magnets 85 to generate an electrical signal and electric power. One of the coils 91 may comprise a pulser coil for providing a signal indicative of the angular rotation of the crankshaft 61, as is well known in the art. In addition, the coil assemblies 91 or the pulser coil may be mounted on the cover member hub 88 by means of a rotatable plate so as to provide for variable spark timing, as is also well known in the art. Alternatively, the variations in spark timing may be accomplished in the CDI unit, to be described, and the coils 91 may be fixed relative to the cover member 87.

The cover member 87 extends vertically upwardly above the cavity 89 in which the flywheel magnetic assembly 82 is contained. Above the flywheel magneto assembly 82 and on the side opposite the cavity 89, there is provided a CDI and electrical component receiving cavity 92. The rear portion of this cavity 92 is defined by a vertical wall 93 of the cover member 87 which is spaced forwardly of the cylinder block 47. A lug 94 is formed on this back surface 93 and is connected to a boss 94 of the cylinder block by a threaded fastener 95 so as to further affix the cover assembly 86 to the engine 29.

The cavities 89 and 92 are separated by a generally horizontally extending wall 96 which is inclined upwardly in a rearward direction. A slot 97 is formed in this wall and permits the passage of electrical conduits 98 that pass from the coils 91 to the CDI cavity 92.

Figure 4:
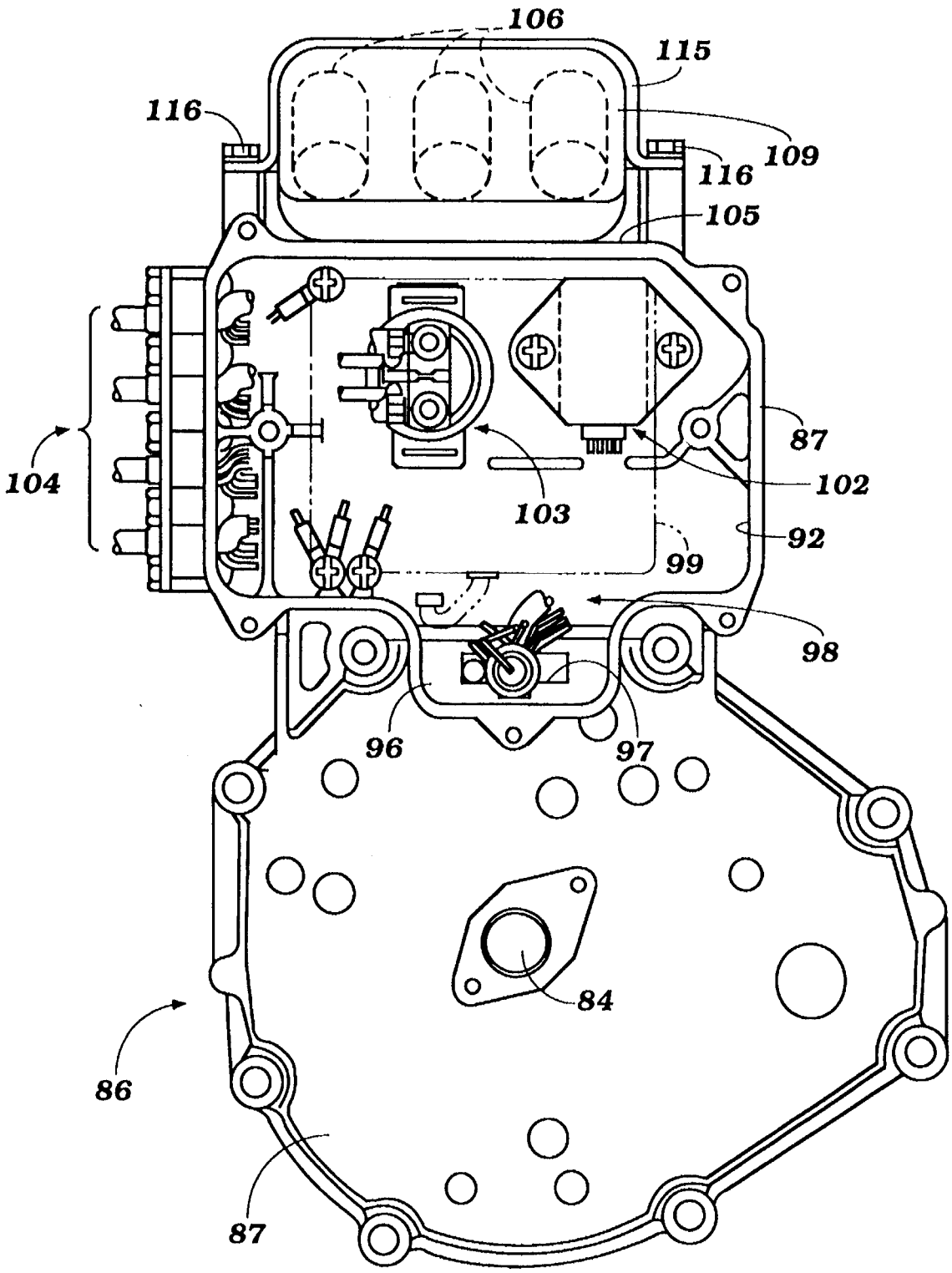
FIG. 4 is an enlarged cross-sectional view taken along the line 4—4 of FIG. 3.

Referring additionally to FIG. 4, it will be seen that a CDI ignition system of any known type, indicated generally by the reference numeral 99 is contained within the cavity 92 and is sealed therein by means of a cover member 101 which completes the cover assembly 86. The CDI ignition unit 99 may be of any known type and supplies electrical current for firing of spark plugs 79 in a manner which will be described.

Also mounted within the cavity 92 and behind the CDI unit 99 are other components for the electrical system of the engine 29. These include a rectifier 102 that cooperates with the coils 92 so as to rectify the output for electrical power supplied to other components of the watercraft. In addition, rectified voltage may be supplied for charging a battery (not shown) positioned within the hull of the watercraft. Also enclosed in the cavity 92 is a starter solenoid 103 for activating a starter motor, in a manner which will be described. One or more fuses 100 are also located in the cavity 92.

A plurality of conductors 104 exit and enter the side of the cavity 92 and are suitably sealed by well known types of grommets or the like. Thus, the electrical componentry of the system is all located conveniently within the cover assembly 86 and the major electrical components are positioned quite close to each other so as to minimize the length of external leads thus further ensuring integrity of the electrical system and efficient operation.

Figure 5:
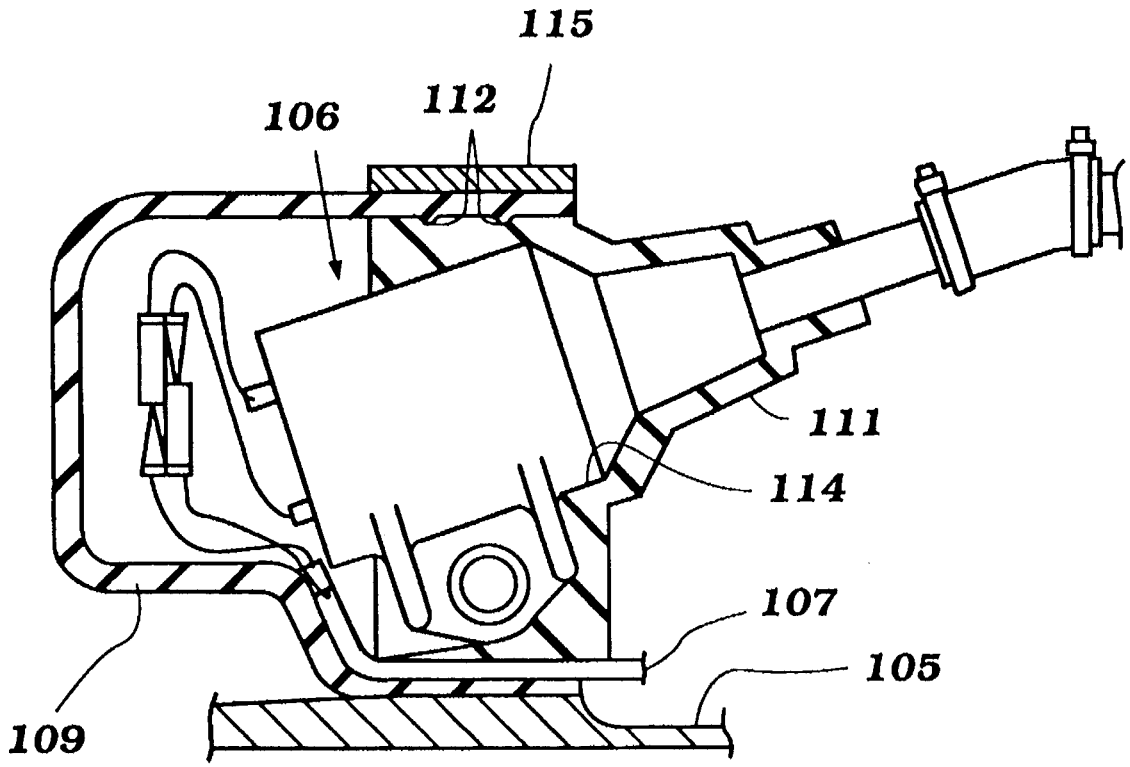
FIG. 5 is an enlarged view showing one of the spark coils, with the surrounding protective boot broken away and shown in cross section.
Figure 6:
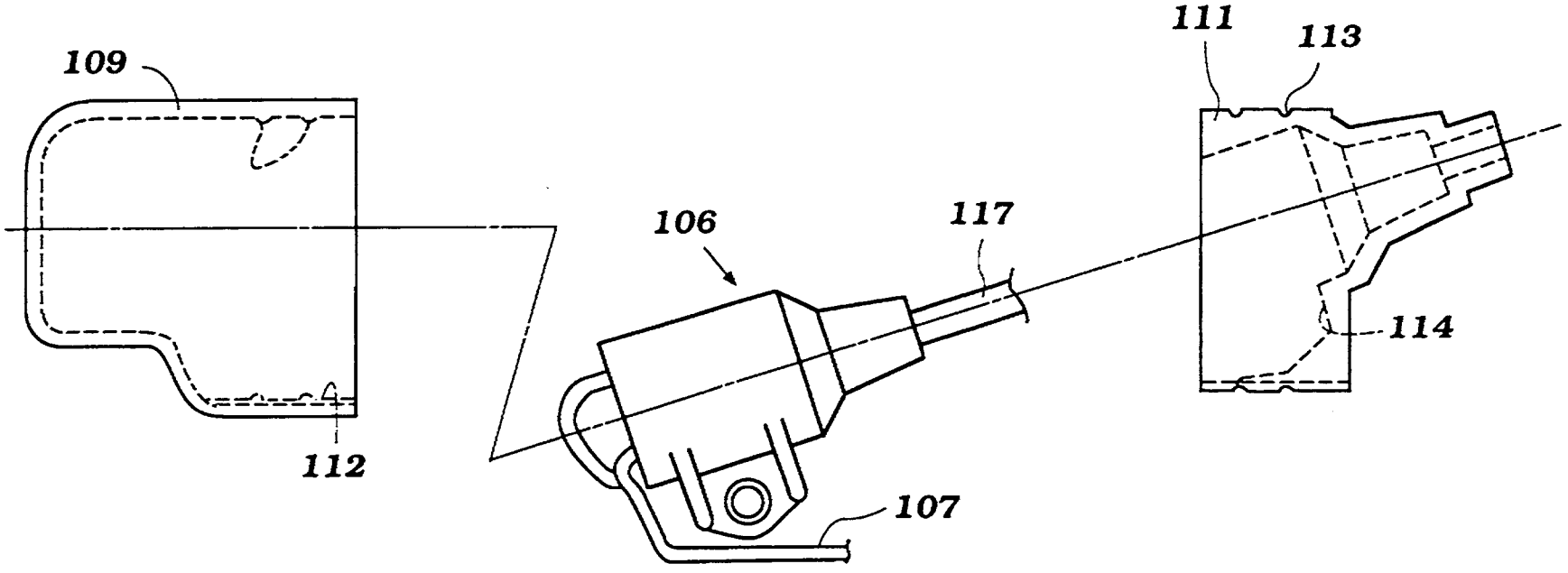
FIG. 6 is an exploded view of the spark coil and its insulating and protective arrangement.

As has been noted, the CDI system 99 fires the spark plugs 79. The way this is done will now be described by further reference to FIGS. 3 and 4 and additionally to FIGS. 5–7. Mounted on a top surface 105 of the cover member 87 above the CDI cavity 92 are three ignition coils, each indicated generally by the reference numeral 106, one for each cylinder of the engine. These coils 106 receive electrical power from the conductors 104 and CDI unit 99, the specific conductors being indicated by the reference numeral 107 in FIG. 5.

Each coil 106 is sealingly contained within an outer boot assembly comprised of a front member 109 and a rear member 111. The front member 109 has a plurality of ribs 112 that are engaged within grooves 113 of the member 111 so as to provide a tight connection and also a water-tight arrangement. The rear member 111 has a front wall 114 that engages the front of the coil 106 so as to locate it and provide further water tightness. It should be noted that there may be provided individual boots for each coil 106 or one common boot for all coils 106.

The coil assembly thus far described is retained on the top of the cover assembly 86 by means of a hold-down bracket 115 that is affixed to the cover assembly 86 and specifically the cover member 87 by threaded fasteners 116.

Each spark coil 106 supplies electrical power to a respective spark plug 79 through a spark cable 117 that is in sealing relationship with the boot 111 and which is inserted, at one end, into the receptacle of the respective coil 106 in a well known manner. A spark plug terminal 108 is affixed to the outer end of each spark cable 107 and is in sealing and electrical conducting relationship with the spark plugs 79 in a well known manner so as to fire them as known in this art.

Figure 8:
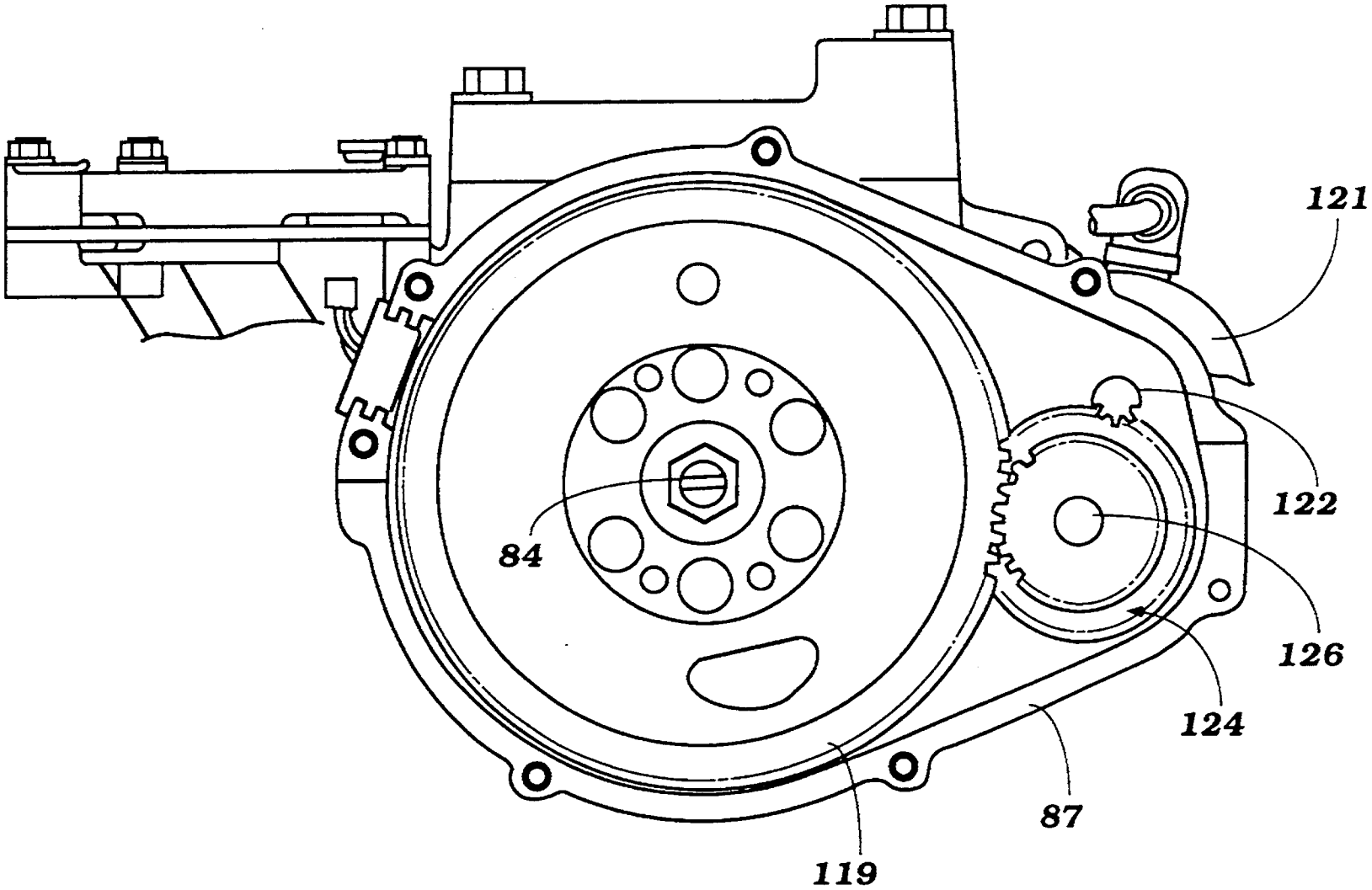
FIG. 8 is a cross-sectional view taken along the line 8—8 of FIG. 3.
Figure 9:
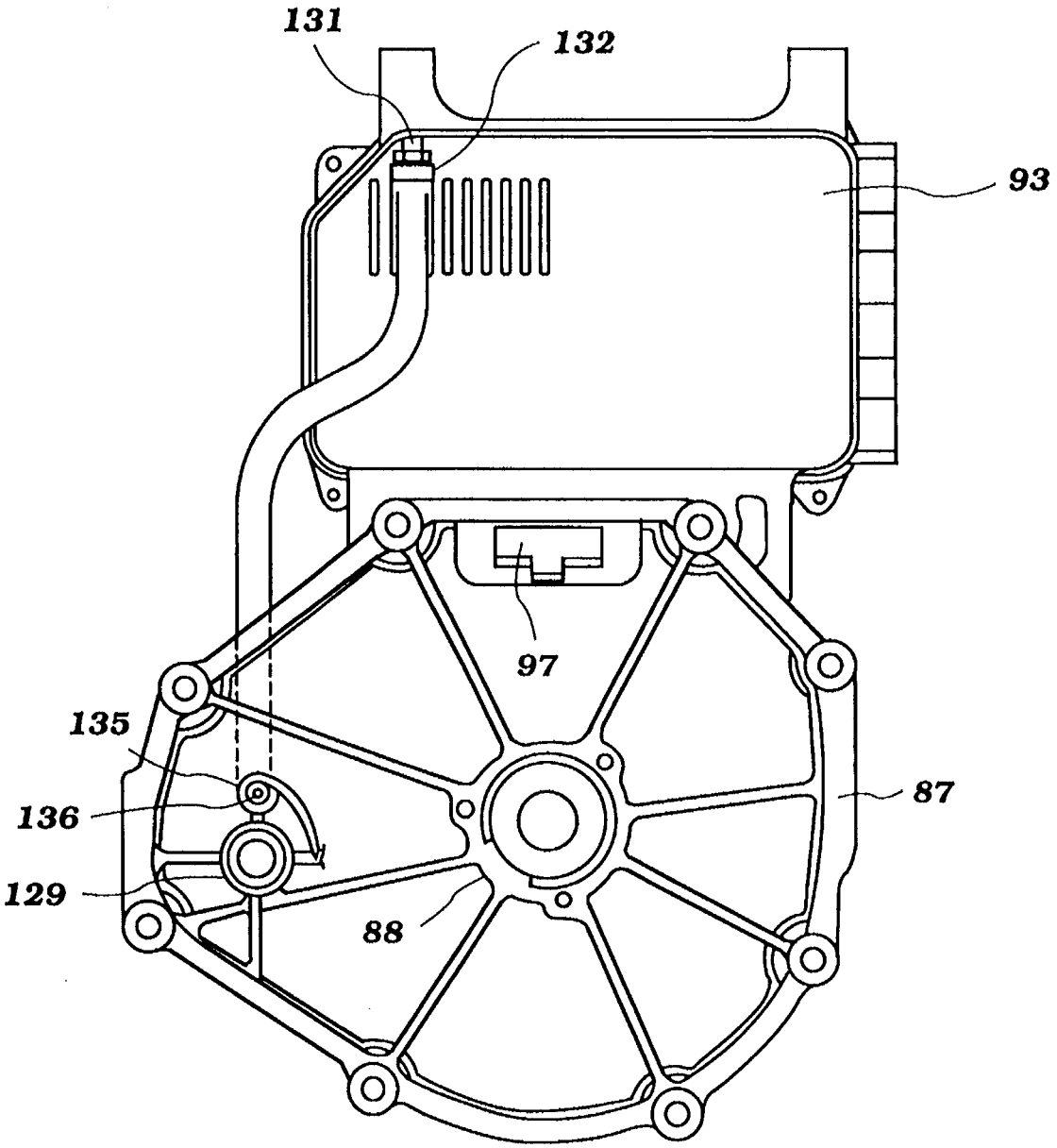
FIG. 9 is a view looking in the opposite direction of FIG. 8.

As has been noted, the engine 29 is provided with an electrical starter which is operated by the starter relay 103. This starter mechanism is shown best in FIGS. 8–10 and cooperates with a starter gear 119 (FIG. 3) which is affixed to the flywheel 83 of the flywheel magneto assembly 82 for rotating the engine crankshaft 61 for electrical starting.

Figure 10:
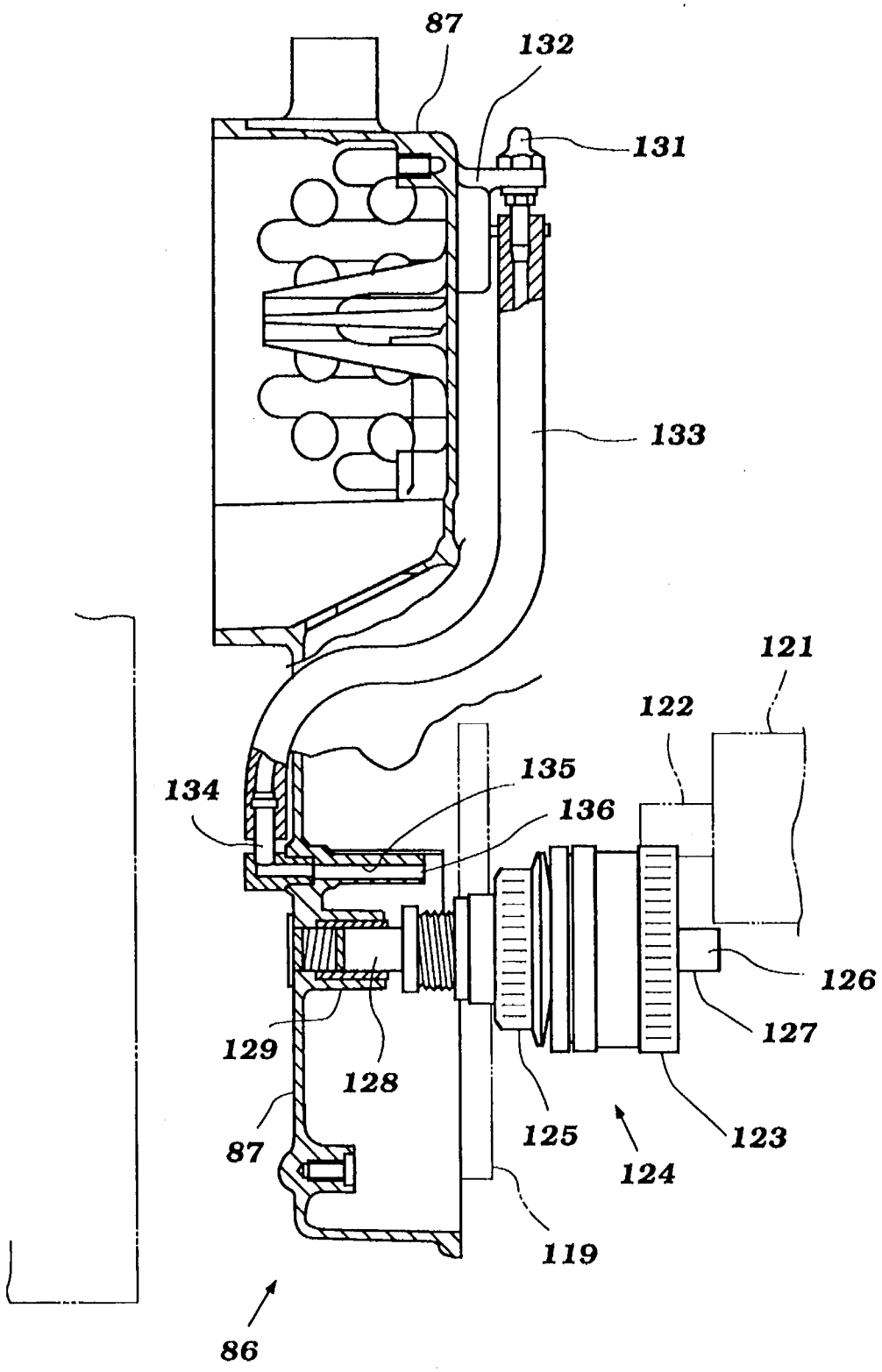
FIG. 10 is a side elevational view, with a portion broken away, showing the lubricating system for the starter mechanism.

This starter mechanism includes an electric starter motor 121, shown in phantom in FIG. 10, and which may be mounted to a side of the cylinder block 47 and/or crankcase member 44 in a suitable manner. This starter motor 121 has an output shaft having a pinion gear 122 which is engaged with and drives a gear 123 of a starter unit 124. The starter unit 124, as is well known in this art, is effective to cause a further pinion gear 125 driven by a ratchet mechanism within the starter mechanism 124 to move axially into engagement with the starter gear 119 of the flywheel for starting operation. This starter mechanism 124 has a main shaft 126 that is fixed or journaled in the crankcase member 44 in a suitable manner via a rear portion 127. A front portion 128 is journaled within a boss 129 of the cover 87.

An arrangement is provided for lubricating the starter mechanism 124 and this includes a lubricating nipple or fitting 131 that is mounted on a boss 132 formed on the rear side of the cover piece 87 at a relatively high location so as to permit ease of servicing. A tube 133 extends downwardly from the nipple or fitting 131 to an L-shaped connector 134 mounted on the front of the cover member 87 and which communicates with a lubricating passage 135 formed integrally in the cover member 87. This passageway terminates at an opening 136 through which lubricant can pass onto the starter mechanism 124 for lubricating its one way clutch and sliding components.

Figure 3:
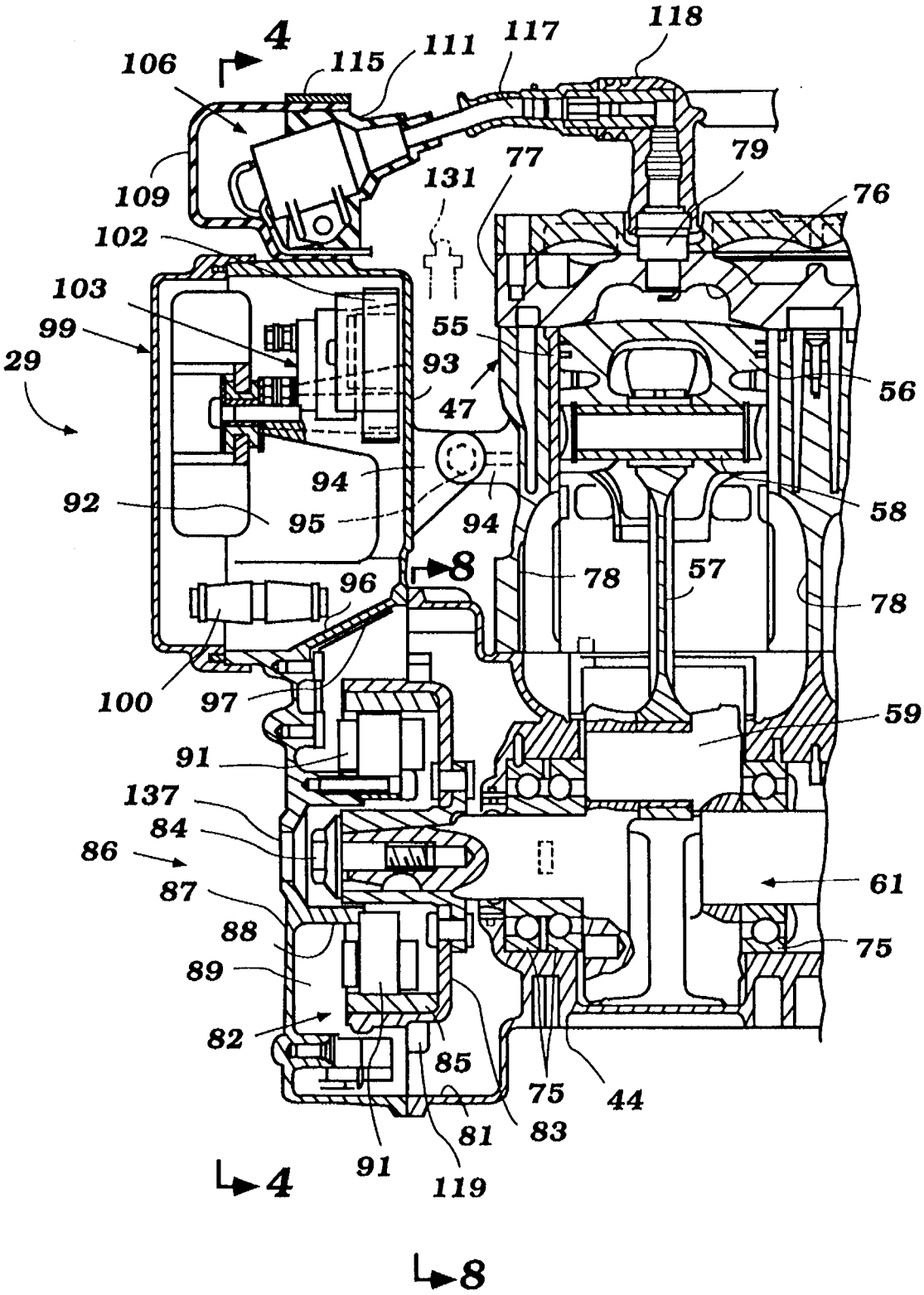
FIG. 3 is an enlarged cross-sectional view of the engine and shows the front cover and components of the ignition system associated therewith.

As may be seen from FIG. 3, the front cover 86 and specifically the cover piece 87 is provided with a small access hole or opening 137 which is aligned with the fastener 84 which holds the flywheel magneto assembly 82 to the crankshaft 61. This access opening 137, if not used for another purpose, can be closed by a closure plug to ensure sealing integrity.

Figure 12:
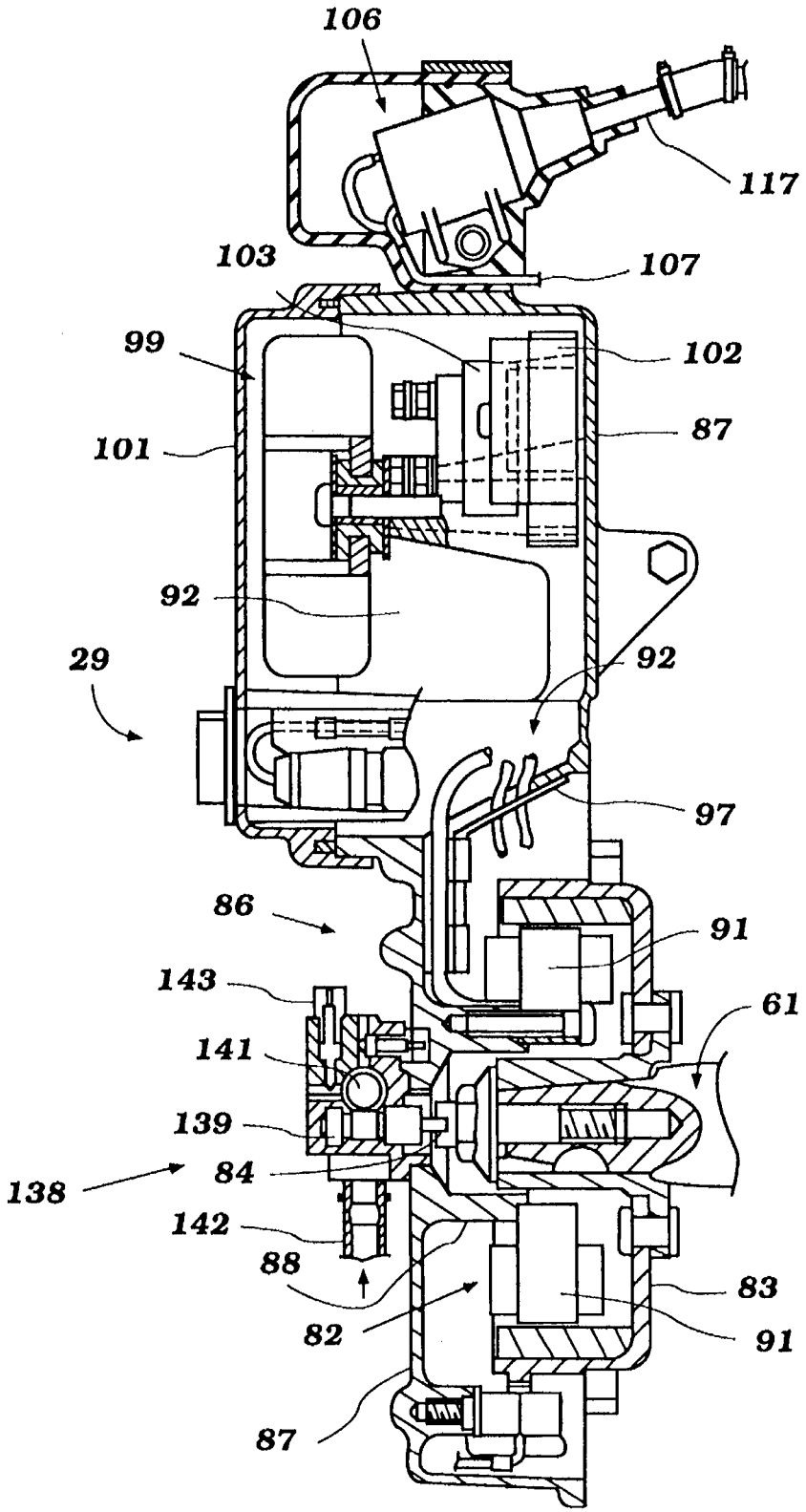
FIG. 12 is a view, in part similar to FIG. 3 and shows a type of accessory such as an oil pump driven off the front end of the crankshaft.

However, if desired, an accessory may be driven off of the crankshaft 61 as shown in FIG. 12 wherein the accessory is an oil pump, indicated generally by the reference numeral 138. The oil pump 138 has a drive shaft 139 which is engaged with a slot in the fastener 84 so as to provide a driving arrangement. This drives a pumping element 141 which is effective to draw lubricant from a remote reservoir through a conduit 142 and deliver it to the engine 29 for its lubrication through one or more conduits 143. Alternatively, other types of accessories may be driven in this manner.

It should be readily apparent from the foregoing description that the described construction provides an extremely effective way of simplifying the electrical system for the engine, maintaining it in a waterproof environment, and positioning where it can be easily serviced. Of course, the foregoing description is that of the preferred embodiment of the invention and various changes and modifications may be made without departing from the spirit and scope of the invention, as defined by the appended claims.

We claim:

1. An internal combustion engine comprising a cylinder block forming at least one cylinder bore, a crankcase member affixed to the lower side of said cylinder block and containing a crankshaft driven by a piston in said cylinder bore, a cylinder head affixed to the upper end of said cylinder block and enclosing said cylinder bore, and at least one spark plug mounted in said cylinder head for firing a charge in said cylinder bore, a front cover affixed to said engine contiguous to an end face thereof, said crankshaft having a portion entering said front cover, a coil mounted in said front cover and juxtaposed to said crankshaft for generating an electrical output upon rotation of said crankshaft, an ignition system sealed within said front cover for receiving an output from said coil and generating a control signal and a power signal for firing said spark plug, and a spark coil mounted externally to said front cover for receiving the output of said ignition system for firing said spark plug.

2. The internal combustion engine as set forth in claim 1, wherein the coil is mounted in the lower portion of the front cover and the ignition system is mounted in the upper portion of the front cover.

3. The internal combustion engine as set forth in claim 2, further including a spark coil mounted on an upper wall of said front cover and receiving the output of said ignition system for firing said spark plug.

4. The internal combustion engine as set forth in claim 3, wherein the engine has a plurality of cylinders each having a spark plug fired by a respective spark coil mounted on the front cover.

5. The internal combustion engine as set forth in claim 4, wherein the spark coils are all mounted within a protective sealing boot.

6. The internal combustion engine as set forth in claim 1, further including a watercraft having a hull in which the engine is contained and a propulsion device driven by the engine.

7. The internal combustion engine as set forth in claim 6, wherein the front cover forms a pair of enclosed compartments one of which contains the coil and the other of which contains the ignition system.

8. The internal combustion engine as set forth in claim 7, wherein the front cover is formed of at least a two-piece construction.

9. The internal combustion engine as set forth in claim 8, wherein the compartments are formed in substantial part by a first piece of the front cover with one of the compartments being formed on the rear side of said piece and the other of the compartments being formed on the front side of the piece.

10. The internal combustion engine as set forth in claim 9, wherein a dividing wall of the one-piece extends between the compartments and further including an opening in said dividing wall for passing conductors between said cavities.

11. The internal combustion engine as set forth in claim 10, wherein the coil is mounted in the lower portion of the front cover and the ignition system is mounted in the upper portion of the front cover.

12. The internal combustion engine as set forth in claim 11, further including a spark coil mounted on an upper wall of said front cover and receiving the output of said ignition system for firing said spark plug.

13. The internal combustion engine as set forth in claim 12, wherein the engine has a plurality of cylinders each having a spark plug fired by a respective spark coil mounted on the front cover.

14. The internal combustion engine as set forth in claim 13, wherein the spark coils are all mounted within a protective sealing boot.

15. An internal combustion engine comprising a cylinder block forming at least one cylinder bore, a crankcase member affixed to the lower side of said cylinder block and containing a crankshaft driven by a piston in said cylinder bore, a cylinder head affixed to the upper end of said cylinder block and enclosing said cylinder bore, and at least one spark plug mounted in said cylinder head for firing a charge in said cylinder bore, a front cover affixed to said engine contiguous to an end face thereof, said crankshaft having a portion entering said front cover, a coil mounted in said front cover and juxtaposed to said crankshaft for generating an electrical output upon rotation of said crankshaft, an ignition system received in said front cover for receiving an output from said coil and generating a control signal and a power signal for firing said spark plug, and a pair of sealingly enclosed compartments formed from said front cover, one of which contains said coil and the other of which contains said ignition system.

16. The internal combustion engine as set forth in claim 15, wherein the front cover is formed of at least a two-piece construction.

17. The internal combustion engine as set forth in claim 16, wherein the compartments are formed in substantial part by a first piece of the front cover with one of the compartments being formed on the rear side of said piece and the other of the compartments being formed on the front side of the piece.

18. The internal combustion engine as set forth in claim 17, wherein a dividing wall of the one-piece extends between the compartments and further including an opening in said dividing wall for passing conductors between said compartments.

19. The internal combustion engine as set forth in claim 18, wherein the coil is mounted in the lower portion of the front cover and the ignition system is mounted in the upper portion of the front cover.

20. The internal combustion engine as set forth in claim 19, further including a spark coil mounted on an upper wall of said front cover and receiving the output of said ignition system for firing said spark plug.

21. The internal combustion engine as set forth in claim 20, wherein the engine has a plurality of cylinders each having a spark plug fired by a respective spark coil mounted on the front cover.

22. The internal combustion engine as set forth in claim 21, wherein the spark coils are all mounted within a protective sealing boot.

* * * * *